United States Patent [19]

Montgomery

[11] 3,938,903

[45] Feb. 17, 1976

[54] HIGHWAY ROADMARKER WITH STUDDED BOTTOM

[75] Inventor: Paul B. Montgomery, Tyler, Tex.

[73] Assignee: Ferro Corporation, Cleveland, Ohio

[22] Filed: Jan. 3, 1975

[21] Appl. No.: 531,792

[52] U.S. Cl. ..... 404/16

[51] Int. Cl.[2] ..... E01F 9/04

[58] Field of Search ..... 404/16, 15

[56] References Cited

UNITED STATES PATENTS

| | | | |
|---|---|---|---|
| 1,986,097 | 1/1935 | Arey | 404/16 |
| 2,337,793 | 12/1943 | Abbott | 404/16 |
| 2,666,373 | 1/1954 | Mattson | 404/16 |
| 2,699,982 | 1/1955 | Batterson | 404/15 |
| 3,179,009 | 4/1965 | Sheffield | 404/16 |
| 3,516,337 | 6/1970 | Gubela | 404/16 X |

*Primary Examiner*—Nile C. Byers

*Attorney, Agent, or Firm*—Milton L. Simmons

[57] ABSTRACT

There is provided a highway lane divider and roadmarker, adapted to be affixed to a pavement surface.

Said marker characterized by a planar base, said base having protruding downwardly therefrom a multiplicity of studs arranged in spaced relationship, and dispersed substantially symmetrically over the area of said base to improve the bonding characteristics of said roadmarker to pavement.

4 Claims, 3 Drawing Figures

HIGHWAY ROADMARKER WITH STUDDED BOTTOM

BACKGROUND OF THE INVENTION

Both reflective and nonreflective highway lane dividers and roadmarkers, of either plastic or glazed ceramic, have been known, and are typified by those disclosed in U.S. Pat. Nos. D 207,038, D 215,376 and D 225,087.

Generally, these roadmarkers are affixed to a pavement surface with a suitable, conventional all-weather adhesive, usually having an epoxy base.

However, due to the various lateral forces the roadmarker is subjected to over a period of protracted exposure to heavy traffic, aggravated by the surface irregularities which occur in various types of pavement, displacement, and consequential replacement, of roadmarkers has posed a rather expensive problem to date.

As disclosed in U.S. Pat. No. 3,499,371, it has been proposed to enhance adherence through the utilization of concentric ridges formed on the bottom of the roadmarker.

However, it has been found that such ridges can actually detract from bonding characteristics because of air entrapment and consequential discontinuity in the epoxy adhesive interface, thereby weakening the bond.

Too, simply cutting radial grooves through the concentric rings of U.S. Pat. No. 3,499,371 would not materially alleviate the problem, as might at first be expected.

OBJECTS

It is therefore an object of this invention to provide a new and improved roadmarker having a studded bottom to improve its pavement bonding characteristics.

It is also an object of this invention to provide a new and improved method for bonding highway lane dividers and roadmarkers to pavement.

DRAWINGS

Referring now to the drawings.

THE INVENTION

Figure 1:
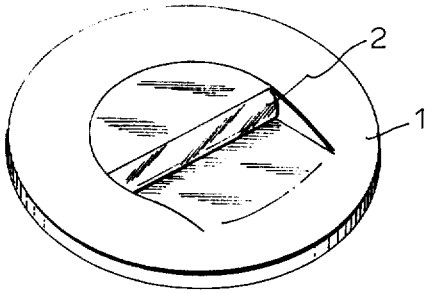
FIG. 1 is a perspective view of the roadmarker of the instant invention.

Referring now to FIG. 1, one embodiment of the roadmarker of this invention, composed of glazed ceramic, is depicted generally by 1. Reflective medium 2 is recessed into the surface of the roadmarker to enhance its utility as a roadmarker at night.

Figure 2:
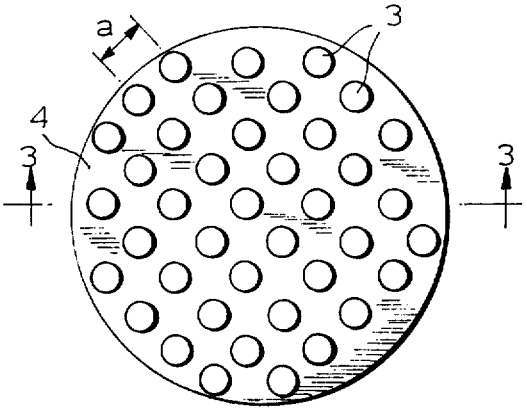
FIG. 2 is a bottom plan view of said roadmarker.

Referring to FIG. 2, which is a plan view of the base of said roadmarker, there are shown substantially cylindrical studs 3 projecting downwardly from said roadmarker.

The marker, if of ceramic, is readily cast, or otherwise formed by conventional methods, fired to maturity, covered with a suitable glaze, then glost fired.

The reflective medium is then cemented into place, using conventional methods and materials.

Figure 3:
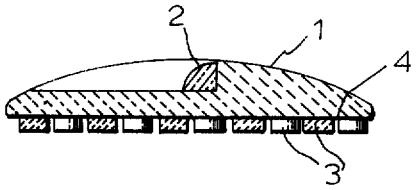
FIG. 3 is an inverted section, 3—3 taken through FIG. 2.

Referring now more particularly to FIGS. 2 and 3, it will be noted that, in order to achieve the preferred embodiment of this invention, substantially cylindrical studs 3 are generally symmetrically dispersed over the area of the base 4 of roadmarker 1. It has been found also, for achieving optimum bondability, that the distance between studs, *a*, should be from 1/32 inch to about ¼ inch or, from about 0.8 to 6.35mm, with the preferred range of spacing being from about 1/16 inch to about ⅛ inch, or from about 1.6 to 3.2mm.

It has also been found that said studs have a critical length range, and should protrude from said base from about 0.025 inch, to about 0.1 inch, or about 0.64 to 2.5mm.

While best results are obtained from studs of generally circular cross section, it is to be understood the studs could be of any fairly symmetrical cross section so long as the cross sectional dimension in any given direction, did not exceed the cross sectional dimension normal to said first mentioned dimension by a ratio greater than 2:1.

As to the minimum number of studs which must be present in order to fully realize the optimum advantages of this invention, this is best expressed in terms of increase in area over the base 4 of said roadmarker, were no studs present.

Thus, the vertical cylindrical surface of the studs only is considered in computing the amount of increased bonding surface, since, if the studs could be theoretically pushed back into the roadmarker until flush with the bottom surface, the bottom surface of the stud would then have to be considered as part of the original base surface.

There must thus be a sufficient number of studs present on the bottom of the marker to provide, at a minimum, an increase of 30% more bonding surface, over the bottom surface of the roadmarker if there were no studs present.

While the increased surface area resulting from the studded feature increases the amount of epoxy bonding agent required, this is more than compensated for by the substantial savings in replacement cost.

Although flat bottomed studs are preferred, they could be formed with either rounded or pointed bottoms. In such design, the vertical surface of the studs would still be used to calculate the amount or percentage of stud surface area vis-a-vis the bottom surface area of the roadmarker, were no studs present.

I claim:

1. In a highway lane divider and roadmarker, adapted to be affixed to a pavement surface, said marker having a substantially planar base, the improvement of said base having a multiplicity of studs protruding therefrom in spaced relationship, said studs having substantially vertical sides, and bottom surfaces substantially parallel to said base, said studs protruding from said base from about 0.025 inch to about 0.1 inch, said studs spaced apart from each other a distance of from about 1/32 inch to about ¼ inch, said studs dispersed substantially symmetrically over the area of said base, with the total exposed surface area of said studs, exclusive of their bottom surfaces, representing at least 30% of the total surface area represented by said base and the bottom surfaces of said studs.

2. The article of claim 1 wherein said studs are spaced apart from each other a distance of from about 1/16 inch to ⅛ inch.

3. The article of claim 1 whereon said studs have a cylindrical cross section.

4. The article of claim 2 whereon said studs have a cylindrical cross section.

* * * * *